United States Patent [19]

Nelson

[11] Patent Number: 4,870,791

[45] Date of Patent: Oct. 3, 1989

[54] ALIGNMENT CLIP MEMBER FOR WINDOWS AND ASSOCIATED METHOD

[75] Inventor: Dwight C. Nelson, Cherry Tree, Pa.

[73] Assignee: Season-all Industries, Inc., Indiana, Pa.

[21] Appl. No.: 123,776

[22] Filed: Nov. 23, 1987

[51] Int. Cl.[4] ..... E06B 1/04

[52] U.S. Cl. ..... 52/217; 52/213; 49/505

[58] Field of Search ..... 52/213, 217; 49/505

[56] References Cited

U.S. PATENT DOCUMENTS

| | | | |
|---|---|---|---|
| 2,481,721 | 9/1949 | Carper | 20/12 |
| 3,571,996 | 3/1971 | Braswell | 52/217 |
| 3,889,423 | 6/1975 | Begin | 49/504 |
| 4,698,944 | 10/1987 | Wilkins, Jr. | 52/217 |

FOREIGN PATENT DOCUMENTS

| | | | |
|---|---|---|---|
| 2547731 | 4/1977 | Fed. Rep. of Germany | 52/217 |

*Primary Examiner*—Michael Safavi

*Attorney, Agent, or Firm*—Arnold B. Silverman

[57] ABSTRACT

An alignment clip for windows and associated method is disclosed. The alignment clip consists of a base, an alignment clip element haivng at least one tab, a spring operatively associated with the base and the alignment clip element and screws which engage screw holes in the alignment clip element. The alignment clip is disposed within a window frame which is designed to hold window sashes. The tabs or the screws or both tabs and screws provide a method of adjusting a window assembly in a window receiving opening.

61 Claims, 7 Drawing Sheets

ALIGNMENT CLIP MEMBER FOR WINDOWS AND ASSOCIATED METHOD

BACKGROUND OF THE INVENTION

1. Field Of The Invention:

The present invention relates to an alignment clip member for windows and an associated method, and more specifically, to an alignment clip member associated with a window frame that can be adjusted to properly install a window in a window receiving opening.

2. Description Of The Prior Art:

There have been several window and/or door assemblies suggested that provide for adjustability of the window and/or door with respect to the frame in which the window and/or door is to be installed.

U.S. Pat No. 3,571,996 discloses a door frame consisting of a pair of jambs traversed at their upper ends by a header. Adjacent to the upper end of the hinge jamb there is a frame positioning assembly consisting of a curved leaf spring and a threaded fastener screw. This position assembly is said to maintain the door securely in place within the opening and also, the patent states, provides an adjustment mechanism for tightening or loosening the frame.

U.S. Pat. No. 2,481,721 discloses a door frame having a sill, side jambs, and head jamb. The patent discloses coil springs which are employed between the back faces of the jamb and the studding surrounding the screws. These springs are said to serve to space the jamb away from the studding, while permitting the screws to draw the jamb towards the studding. The springs are also said to provide a way of adjusting the frame once the frame has been nailed to the studding.

U.S. Pat. No. 3,889,423 discloses a door frame which includes a shim member having a threaded hole into which a screw is engaged. Turning the screw causes outward movement of the shim and corresponding inward reaction movement of the frame member.

Despite these devices, there remains a need for an alignment member that provides an adjustment means that facilitates easy and proper installation of a window frame and window assembly into a window receiving opening.

SUMMARY OF THE INVENTION

The alignment clip member for windows and associated method has met the above-mentioned need. The alignment clip member consists of a base, an alignment clip element means associated with the base having at least one tab means, spring means operatively associated with the base and alignment clip element means for biasing the alignment clip element means with respect to the base, and screw means which engage screw holes in the alignment clip element means. The tab means or the screw means or both working in concert provide a method of adjustment the window frame in a window receiving opening.

It is an object of the invention to provide an alignment clip for windows that facilitates easy and proper installation of the window frame with which the alignment clip is associated into a window receiving opening.

It is a further object of the invention to provide adjustment means associated with the alignment clip member which are easy to use.

It is a further object of the invention to provide spring means to insure a tight fit of the window frame with the window receiving opening no matter how the alignment clip is adjusted.

It is a further object of the invention to provide an inexpensive and durable window alignment clip for a window frame and assembly.

It is a further object of the invention to provide different length tab means to provide different adjustment positions.

It is a further object of the invention to provide screw means which can provide a range of different adjustment positions for the alignment clip.

It is a further object of the invention to provide both tab means and screw means to provide an even larger range of adjustment positions for the alignment clip.

It is a further object of the invention to provide an alignment clip that forces the window frame inwardly to adjust for any bowing that may occur in the window assembly.

It is a further object of the invention to provide an alignment clip that will hold the window assembly in a square and plumb position until window installation screws can be installed.

These and other objects of the invention will be fully understood from the following description of the invention with reference to the illustrations appended to this Application.

DESCRIPTION OF THE PREFERRED EMBODIMENT

Figure 1:
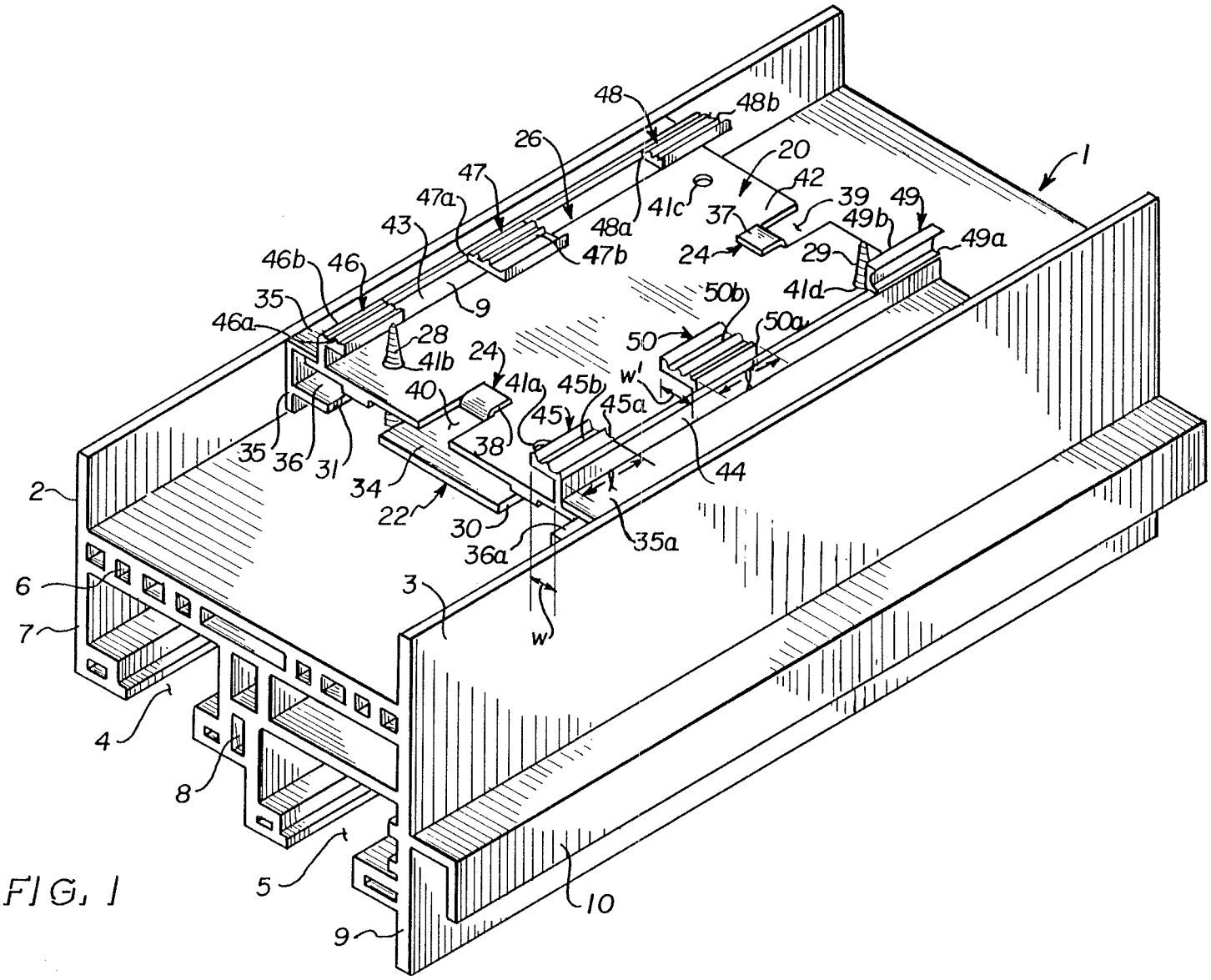
FIG. 1 is a perspective view of the alignment clip mounted on part of a window frame extrusion.

Referring now to FIG. 1, the alignment clip member 20 is shown mounted in a recess of a window frame prime jamb 1. The window frame prime jamb 1 is an extrusion preferably made of aluminum or vinyl and can be used with any desired type of window frame such as single, double, or triple hung, slider, or picture windows. Also, the invention is not limited to window frames, but can be used on any other type of frame that must be placed in a fixed opening such as doors, for example. Therefore, the term "window" as used herein can mean windows, doors, or other building products having a frame and a panel which are designed to be placed in an opening receiving portion in a bulding. Herein, however, window frames will be used as the example to illustrate the preferred embodiment.

Preferably, the thickness of the alignment clip member 20 is no higher than that of the sides 2 and 3 of the window frame prime jamb 1. Side 2 is preferably placed on the inside of a building, whereas the wider side 3 is preferably positioned on the outside of the building. The alignment clip member 20 of the invention will be discussed in more detail hereinbelow with reference to FIGS. 2-8.

The window frame prime jamb 1 illustrated has recesses 4 and 5 for receipt of two window sashes (not shown here but described hereinbelow with reference to FIG. 12). The recesses are defined by the base 6 of the window frame prime jamb 1 and outwardly extending flanges 7, 8, and 9 as is well known to those skilled in the art. The prime jamb 1 also has a protrusion 10 which functions as a screen track.

Figure 2:
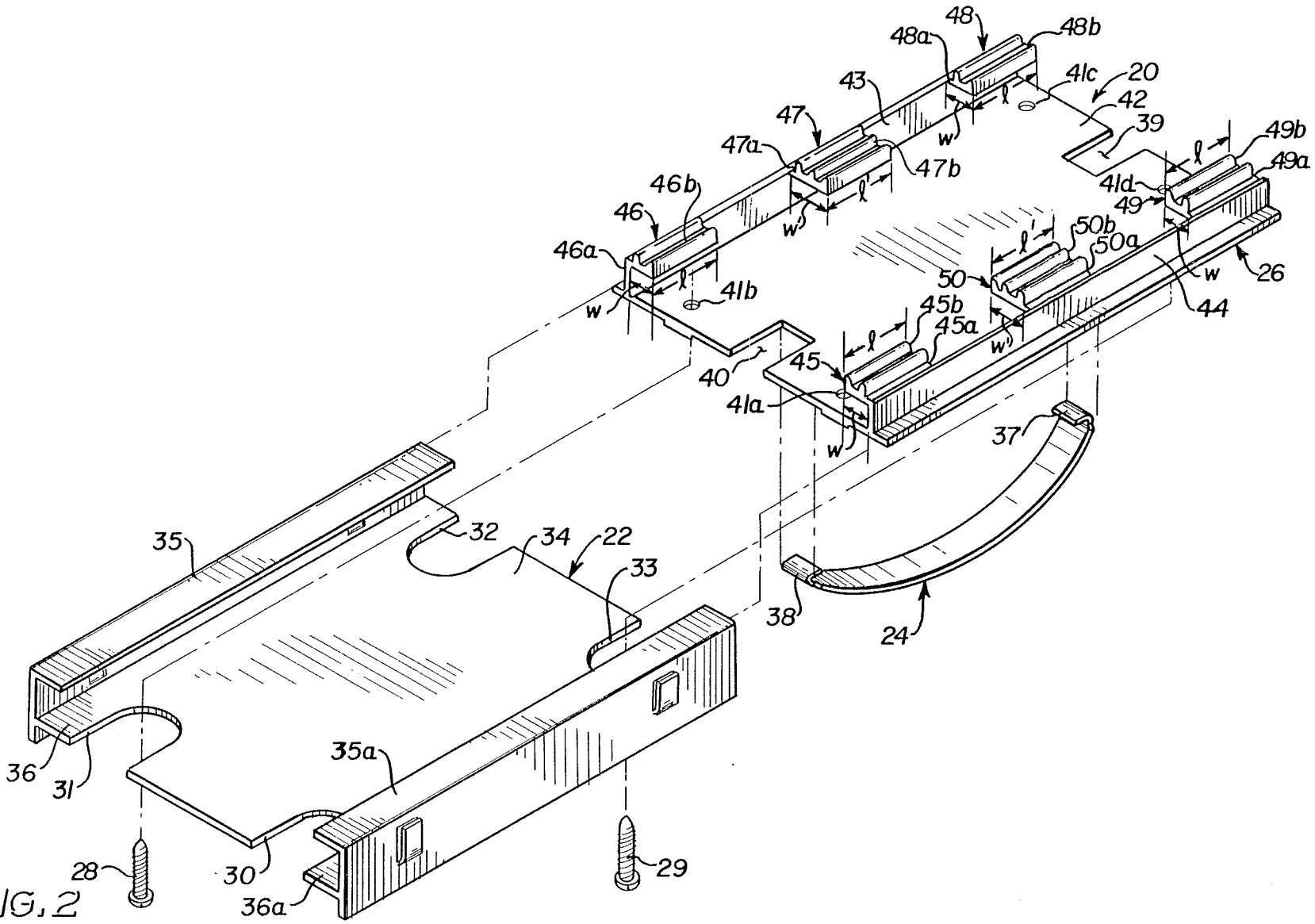
FIG. 2 is an exploded perspective view of the alignment clip of the present invention.
Figure 3:
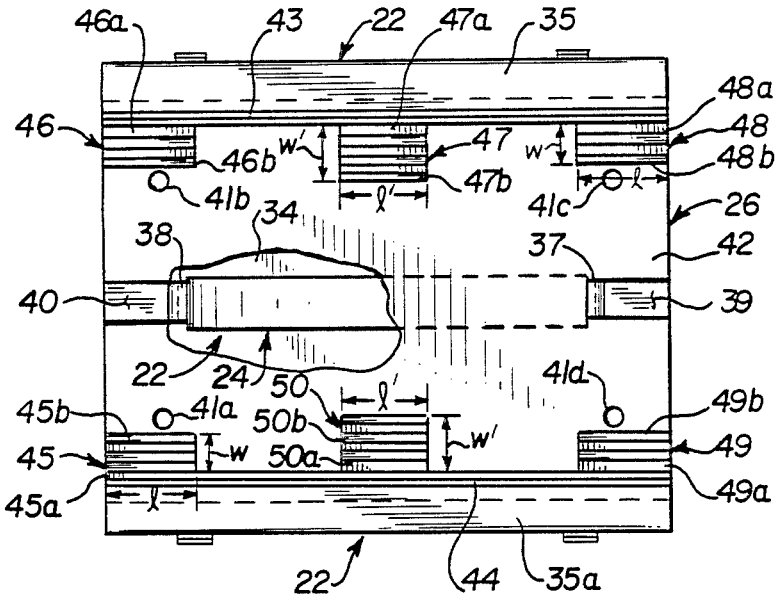
FIG. 3 is a top plan view, partially in section, of the alignment clip of the present invention.

Referring now to FIGS. 1 and 2, there is shown the alignment clip member 20 and an exploded perspective view of the alignment clip member 20, respectively. The alignment clip member 20 consists of a base 22, a leaf spring 24, an alignment clip element 26, and preferably two screws 28 and 29. The screws 28 and 29 are preferably positioned on opposed ends and across from each other on the alignment clip member 20. When assembled, the alignment clip member 20 is preferably about 3 to 4 inches long, 2 to 3 inches wide, and about ½ to 1 inch in total height. The base 22 and alignment clip element 26 are preferably made of aluminum or other suitable material of sufficient strength and durability so as to function effectively. The leaf spring 24 is preferably made of a resilient material such as spring steel.

Figure 4:
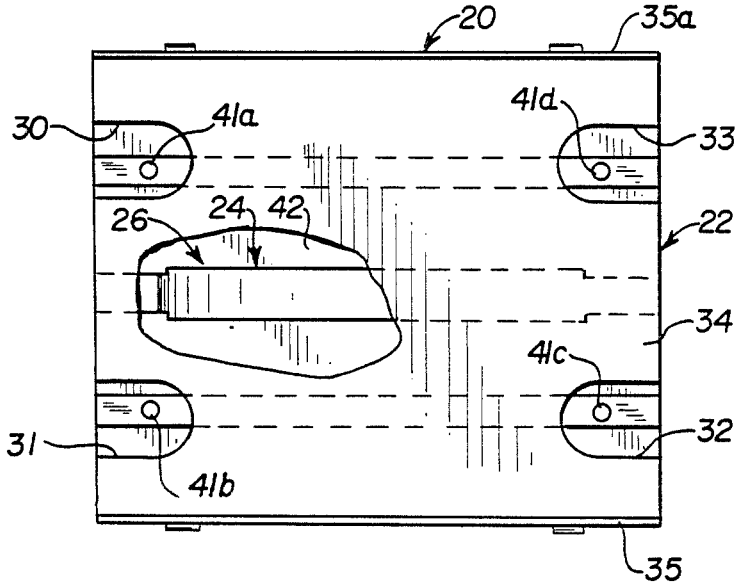
FIG. 4 is a bottom plan view, partially in section, of the alignment clip.
Figure 5:
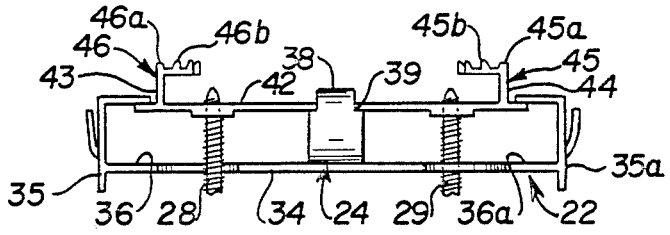
FIG. 5 is a right side elevational view, partially in section, of the alignment clip.
Figure 6:
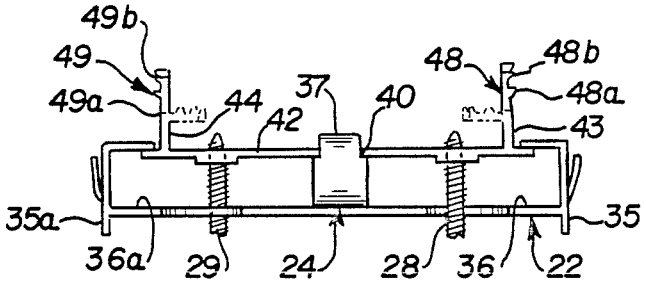
FIG. 6 is a left side elevational view, partially in section, of the alignment clip showing the tabs in their extended position.

As can best be seen in FIGS. 2 and 4, the base 22 is preferably generally rectangular in shape with preferably four semicircular indentations 30–33. These indentations facilitate securing the alignment clip member 20 to the window frame 1 as will be explained hereinbelow with respect to FIGS. 9–11. The base 22, as can be seen in FIG. 1, consists of a plate portion means 34 and two generally upwardly extending lateral flanges 35 and **35*a* on either side of the base 22. The flanges 35 and 35*a* each terminate in generally inwardly directed reentrant flange portions 36 and 36*a* where portions of the alignment clip element 26 can be positioned. The reentrant flange portions 36 and 36*a* contact the sidewalls of the alignment clip element 26. The base 22** is preferably made of an aluminum extrusion and may be formed by punching out desired portions.

The leaf spring 24 has preferably a fifty to sixty pound tension limit. As can be seen in FIG. 2, the ends 37 and 38 of the spring 24 are curved to form reentrant flange portions to facilitate mounting of the spring 24 to the alignment clip element 26. It will be appreciated that other types of springs such as a coil compression spring, for example, may be used in place of leaf spring 24.

The alignment clip element 26 is also preferably rectangular in shape and is somewhat smaller in width than the base 22. The alignment clip element 26 has preferably two spring holder recesses 39 and 40 for holding spring 24 and also has preferably four screw holes **41*a*–41*d* which can be used for holding screws such as screws 28 and 29**.

As can be seen from FIGS. 1–3 and 5–6, the alignment clip element means 26 has a bottom wall 42, a first sidewall 43, and a second sidewall 44. The sidewalls 43 and 44 extend upwardly and generally perpendicularly to the bottom wall 42 and are positioned on opposite lateral portions respectively, of the alignment clip means 26.

The tab means 45–50 are also shown in FIGS. 1–3 and 5–6. The tab means 45–50 are preferably integrally formed to their respective sidewalls 43 and 44 and are preferably positioned in a generally spaced parallel relationship with the bottom wall 42. The tab means 45–50 extend inwardly from the upper portion of the sidewalls 43 and 44 and are adapted to be rotated generally upwardly and outwardly at a hinge axis **45*a*–50*a* to assume a position generally aligned with the respective sidewalls 43 and 44. The hinge axis 45*a*–50*a* is defined at the upper portion of the sidewalls 43 and 44. This position can be seen in FIG. 6. The tabs 45–50** can be bent upwardly by a workman using a pair of pliers or a screwdriver, for example.

Figure 1A:
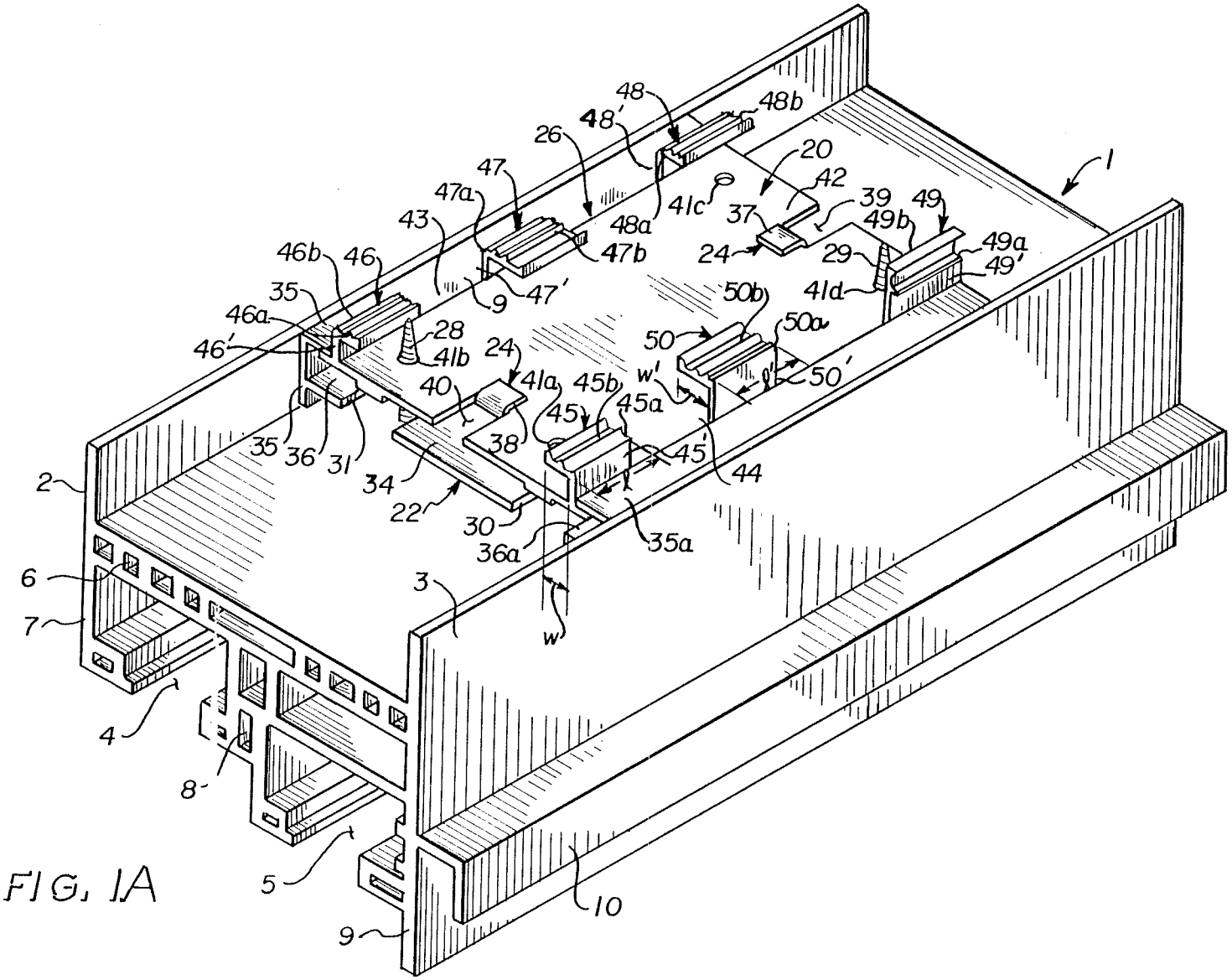
FIG. 1A is a perspective view of another embodiment of the alignment clip mounted on part of a window frame extrusion.

The sidewalls 43 and 44 are shown in the preferred embodiment as being continuous along the lateral portions of the alignment clip element means 26. However, the sidewalls could also be discontinuous, that is, each tab means 45–50 could extend from a separate sidewall, these sidewalls being disconnected from the other sidewalls on that particular lateral portion of the alignment clip element means. FIG. 1A shows an embodiment with discontinuous separate sidewalls 45', 46', 47', 48', 49', and 50' associated with tabs 45–50, respectively.

As can best be seen in FIGS 1–3 and 5–6, the alignment clip element means 26 has six tab means 45–50. The first sidewall 43 has three tab means 46, 47, and 48 and the second sidewall 44 has three tab means 45, 50, and 49. Each of the tab means 45–50 has stiffener ribs **45*b*–50*b* to strengthen the material used for the tab means 45–50. It is preferred that the tab means are generally aligned with each other, so that tab 46 is aligned with tab 45, tab 47 is aligned with tab 50 and tab 48 is aligned with tab 49**.

The tab means 45–50 are preferably all of the same length 1. However, the width w of the outer tabs 45, 46, 48, and 49 is preferably less than the width w' of the inner tabs 47 and 50.

As will be explained hereinbelow, the tabs 45–50 are used to position the window frame 1 in a window receiving opening. As the outer tabs 45, 46, 48, and 49 have a different width w than the inner tabs 47 and 40, width w', the alignment clip 10 and therefore the window frame 1 can assume different widths, thus giving the frame 1 the ability to fit into different sized window receiving openings.

It will be appreciated that the sidewall portions 43 and 44 may, for example, range in height from about ¼ inch to ⅝ inch although this is not to be construed as a limitation on the size thereof. It is preferred that the tab portions 45, 46, 48, and 49 be of the same longitudinal extent to facilitate placement of the window frame (not shown) with the alignment clip member 20 into a window receiving opening. This is because the position of these tabs makes for a symmetrical alignment of the axially extending portions 45, 46, 48, and 49. This is also the case with tab portions 47 and 50.

Figure 7:
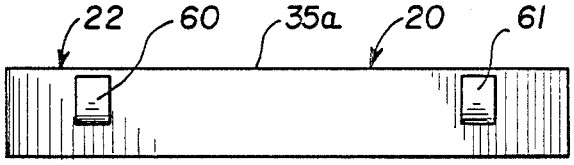
FIG. 7 is a front elevational view of the alignment clip.
Figure 8:
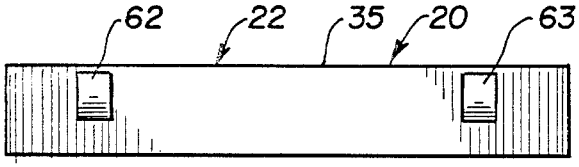
FIG. 8 is a rear elevational view of the alignment clip.

FIGS. 7 and 8 show front and rear elevational views of the alignment clip member 20. This view shows projections 60–63 which are placed on the flange 35 of the base 22 which aid in fitting the alignment clip member 20 securely into the window frame as will be explained hereinbelow. FIG. 7 shows projections 60 and 61 and FIG. 8 shows projections 62 and 63.

Figure 9:
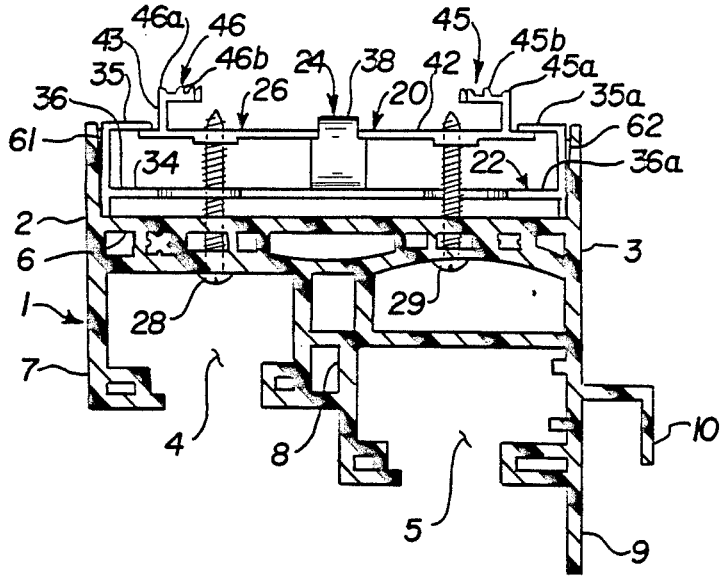
FIG. 9 is a right side elevational view of the alignment clip mounted in the window frame showing the alignment clip member in a non-compressed position.
Figure 10:
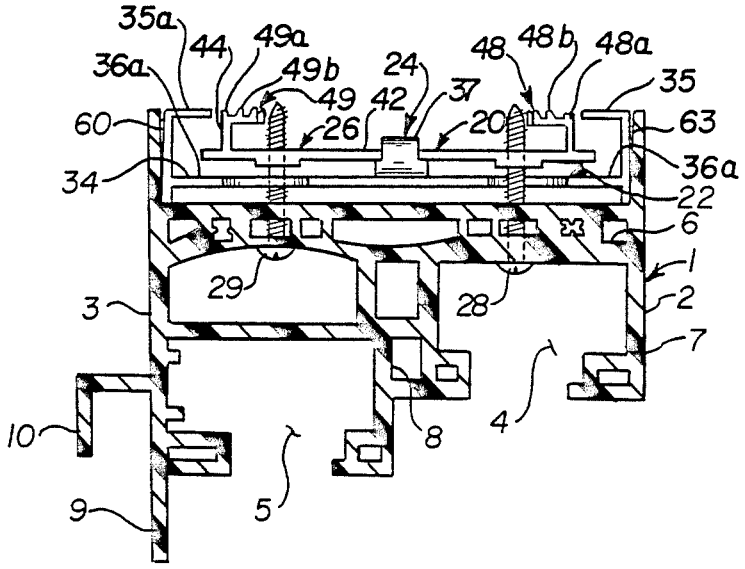
FIG. 10 is a left side elevational view of the alignment clip mounted in the window frame showing the alignment clip in a compressed position.

FIGS. 9 and 10 show the compressive action of the alignment clip member 20 against the frame 1. The alignment clip element 26 is able to move translationally with respect to the frame 1 by pushing down on the alignment clip member 20, which in turn compresses the spring 24. This downward movement is illustrated in the change in the position of the alignment clip element 26 from FIG. 9 to FIG. 10. This will allow the alignment clip member 20 to fit snugly against a window receiving opening when the screws 28 and 29 and/or the tabs 45–50 are used to adjust the position of the window frame in the window receiving opening and even when the screws 28 and 29 and tabs 45–50 are not used.

Figure 11:
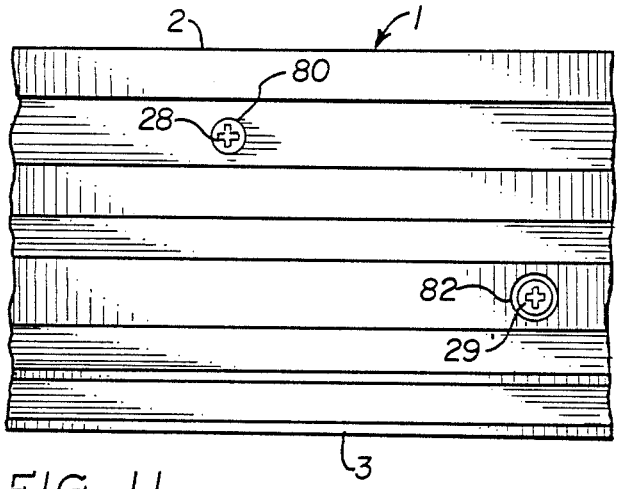
FIG. 11 is a bottom plan view of the frame showing the adjustment screws.

FIG. 11 shows a top plan view of the frame 1 showing the holes 80 and 82 where the screws 28 and 29 respectively engage the alignment clip member 20. The holes 80 and 82 are drilled and tapped (using self threaded screws) through the frame 1 and the screws 28 and 29 pass through the frame and by pass the base 22 at indentations 30–33 and engage the alignment clip element 26 at screw holes 41*a*–41*d*. The screws 28 and 29 then can engage the window receiving opening, as will be described hereinbelow.

Figure 12:
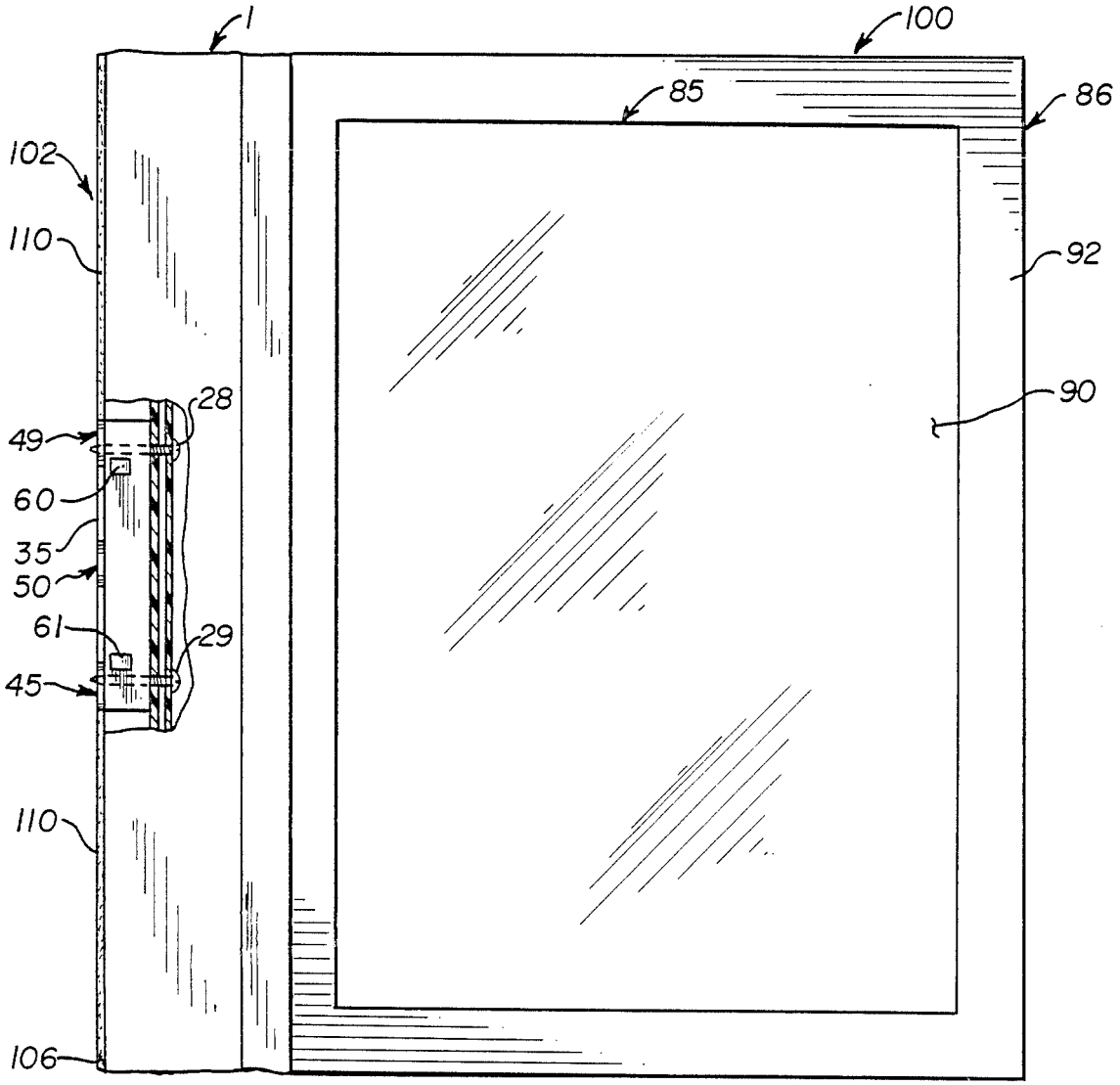
FIG. 12 is an elevational view, partially in section, of the alignment clip and the window frame associated with a window assembly which is installed in a window receiving opening.

FIG. 12 shows the alignment clip member 20 mounted in the window frame 1, holding two window sashes 85 and 86 having panels 90 and 92, respectively, which in this embodiment are panes of glass or other transparent material. The window assembly, designated by reference number 100, consists of the window frame 1, the alignment clip member 20 mounted therein, and the window sashes 85 and 86. The window assembly 100 is placed in a window receiving opening 102 in a residential housing or other building construction.

As can be seen in FIG. 12, tabs 45 and 49 are extended so as to be aligned with sidewalls 43 and 44, respectively, and are shown engaging the window receiving opening 102. Tabs 46 and 48 (not shown in this view) are also extended on the opposite side of the alignment clip member 20. It will be appreciated that the tabs provide a method of adjusting the window assembly 100 to fit into a window receiving opening 102. The different sized tabs, of course, provide different spacing between the alignment clip member 20 and the window receiving opening 102. Also, spacing can be provided by not rotating the tabs 45–50.

The final adjustment of the window assembly 100 is accomplished by rotating the screws 28 and 29 in a first direction to urge the alignment clip member 20 against the action of the leaf spring 24 or in a second direction to release the alignment clip member 20 from the action of the leaf spring 24. This provides a range of adjustments for the alignment clip member 20. The screws 28 and 29 then engage the window receiving opening 102.

After the frame 1 with the alignment clip member 20 has been installed, the frame 1 is further secured to the window receiving opening 102 by window frame screws (not shown) or other fasteners well known to those skilled in the art. Any gaps 106 between the window assembly 100 and the window receiving opening 102 can be filled with caulking 110. Finally, the window sashes 85 and 86 are installed to complete the window assembly 100.

It will be appreciated that the window assembly 100 is preferably provided with several alignment clip members in order to insure proper fit of the window assembly 100 into the window receiving opening.

It will be appreciated, therefore, that there are two methods of adjustment, the tab means 45–50, and the rotation of the screws 28 and 29. The translational movement of the alignment clip element 26 with respect to the spring 24 acts to tightly and securely fit the window assembly 100 into the window receiving opening 102 once the adjustment to the tab means 45–50 and screws 28 and 29 have been made.

The method of the invention involves the steps of providing a window assembly 100 having separate window sashes 85 and 86 and a window frame 1, the window frame 1 having the alignment clip member 20 as described hereinabove mounted therein, inserting the window assembly 100 into the window receiving opening 102 and compensating for gaps between the window assembly and window receiving opening by adjusting the alignment clip member 20 by adjusting the tab means 45–50 and/or the screw means 28 and 29.

It will be appreciated that while we have mentioned certain materials that are used for the various parts of the window assembly, that these recitations are not to be construed as a limitation thereof, and suitable materials may be substituted therefor.

It will be appreciated that the present invention provides an alignment clip and an associated method that simply and efficiently allows for tight, secure positioning of a window assembly into a window receiving opening.

Whereas a particular embodiment of the invention has been described above, for purposes of illustration, it will be evident to those skilled in the art that numerous variations of the details may be made without departing from the invention as defined in the appended claims.

I claim:

1. An alignment clip member for use in a window frame having a recess adjacent to a window receiving opening comprising base means for positioning within said recess of said window frame, alignment clip element means adjacent to said base means having deformable tab means for adjusting the spacing between said window frame and said window receiving opening, spring means operatively associated with said base means and said alignment clip element means for biasing said alignment clip element means with respect to said base means, and screw means engaging said alignment clip element means, said window frame and said window receiving opening, whereby said alignment clip element means may be altered to compensate for variations in said window receiving opening by either rotating said screw means so as to alter the relative spacing between said base means and said alignment clip element means or by adjusting said tab means or both.

2. The device of claim 1, including said base means being substantially rectangular and having a plurality of indentations to permit said screw means to pass through said base means without engaging said base means.

3. The device of claim 2, including
said alignment clip element means being substantially rectangular and having recesses that facilitate mounting of said spring means to said alignment clip element means.

4. The device of claim 3, including
said alignment clip element means having a plurality of screw hole means.

5. The device of claim 4, including
said alignment clip element means having a bottom wall and a first sidewall and a second sidewall, each said sidewall extending upwardly from opposite lateral portions of said alignment clip element means in a generally perpendicular relationship to said bottom wall, said tab means being secured to said sidewall and positioned in a generally spaced parallel relationship with said bottom wall.

6. The device of claim 5, including
said tab means extending generally transversely inwardly from said sidewalls and having a hinge axis whereby said tab means is adapted to be rotated generally upwardly and outwardly at said hinge axis to assume a position generally aligned with said sidewalls.

7. The device of claim 6, including
said sidewalls being continuous along said lateral portions of said opposite lateral portions of said alignment clip element means.

8. The device of claim 6, including
said sidewalls being discontinuous along said lateral portions of said opposite lateral portions of said alignment clip element means.

9. The device of claim 7, including
said slignment clip element having a plurality of tab means.

10. The device of claim 9, including
said tab means on said first sidewall being generally aligned with said tab means on said second sidewall.

11. The device of claim 10, including
said first sidewall having substantially the same number of tab means as said second sidewall.

12. The device of claim 11, including
said tab means on each sidewall having at least one tab means of different width than the other tab means.

13. The device of claim 12, including
said first sidewall having three tab means and said second sidewall having three tab means.

14. The device of claim 13, including
said different width tab means of each said sidewall being generally aligned and being positioned between the other two said tab means.

15. The device of claim 14, including
said different width tab means having a greater width than said other two tab means.

16. The device of claim 15, including
said tab means having substantially the same length.

17. The device of claim 16, including
said tab means having stiffener ribs, whereby strength of said tab means is enhanced.

18. The device of claim 4, including
said screw means passing through said base means and engaging said alignment clip element means in said screw holes in said alignment clip element means.

19. The device of claim 1, including
said base means and said alignment clip element means being made of aluminum.

20. The device of claim 1, including
said spring means being a leaf spring.

21. The device of claim 18, including
said screw means comprising two screws each disposed at generally opposed ends of said alignment clip element means.

22. The device of claim 2, including
said base means having plate means having generally upwardly extending opposed lateral flanges, each said flange terminating in generally inwardly directed reentrant flange portions and said reentrant flange portions contacting said alignment clip element means.

23. The device of claim 22, including
said reentrant flange portions functioning as guide means for allowing translational movement of said alignment clip element means.

24. A window frame adjacent to a window receiving opening comprising
an elongated window frame extrusion having a recess, and
an alignment clip member associated with said window frame having a base means for positioning within said recess of said window frame, alignment clip element means adjacent to said base means having deformable tab means for adjusting the spacing between said window frame extrusion and said window receiving opening, spring means operatively associated with said base means and said alignment clip element means for biasing said base means with respect to said alignment clip element means and screw means engaging said alignment clip element means, said window frame and said window receiving opening, whereby said window frame can be adjusted to be positioned in said window receiving opening by either rotating said screw means so as to alter the spacing between said base means and said alignment clip element means or by adjusting said tab means to alter the spacing between said alignment clip element means and said window receiving opening or both.

25. The window frame of claim 24, including
said base means being substantially rectangular and having a plurality of indentations to permit said screw means to pass through said base means without engaging said base means.

26. The window frame of claim 25, including
said alignment clip element means being substantially rectangular and having recesses that facilitate mounting of said spring means to said alignment clip element means.

27. The window frame of claim 26, including
said alignment clip element means having a plurality of screw hole means.

28. The device of claim 27, including
said alignment clip element means having a bottom wall and a first sidewall and a second sidewall, each said sidewall extending upwardly from opposite lateral portions of said alignment clip element means in a generally perpendicular relationship to said bottom wall, said tab means being secured to said sidewalls and positioned in a generally spaced parallel relationship with said bottom wall.

29. The device of claim 28, including said tab means extending generally transversely inwardly from said sidewalls and having a hinge axis, whereby said tab means is adapted to be rotated generally upwardly and outwardly at said hinge axis to assume a position generally aligned with said sidewalls.

30. The device of claim 29, including said sidewalls being continuous along said lateral portions of said opposite lateral portions of said alignment clip element means.

31. The device of claim 29, including said sidewalls being discontinuous along said lateral portions of said opposite lateral portions of said alignment clip element means.

32. The device of claim 28, including said alignment clip element having a plurality of tab means.

33. The device of claim 32, including said tab means on said first sidewall being generally aligned with said tab means on said second sidewall.

34. The device of claim 33, including said first sidewall having substantially the same number of tab means as said second sidewall.

35. The device of claim 34, including said tab means on each sidewall having at least one tab means of different width than the other said tab means.

36. The device of claim 35, including said first sidewall having three tab means and said second sidewall having three tab means.

37. The device of claim 36, including said different width tab means of each said sidewall being generally aligned and being positioned between the other two tab means.

38. The device of claim 37, including said different width tab means having a greater width than said other two tab means.

39. The device of claim 38, including said tab means having substantially the same length.

40. The device of claim 39, including said tab means having stiffener ribs, whereby strength of said tab means is enhanced.

41. The device of claim 27, including said screw means passing through said base means and engaging said alignment clip element means in said screw holes in said alignment clip element means.

42. The device of claim 24, including said base means and said alignment clip element means being made of aluminum.

43. The device of claim 24, including said spring means being made of steel.

44. The device of claim 41, including said screw means being positioned at opposed ends and across from each other on said alignment clip element means.

45. The device of claim 25, including said base means having plate portion means and generally upwardly extending opposed lateral flanges each said flange terminating in generally inwardly directed reentrant flange portions, said reentrant flange portions contacing said alignment clip element means.

46. The device of claim 45, including said reentrant flange portions functioning as guide means for allowing translational movement of said alignment clip element means.

47. The device of claim 24, including said alignment clip member being secured to said window frame by said screw means being driven into said frame, passing through said base means and engaging said alignment clip element means and said window receiving opening.

48. The device of claim 47, including said alignment clip member being compressed against said window frame by said spring means, whereby said window frame is in a tight, secure fit with a window receiving opening after adjusting said frame by means of said screw means or said tab means or both.

49. A window assembly consisting of a window frame extrusion having a recess adjacent to a window receiving opening within which is received the edges of said window frame extrusion, a window sash having a panel which is designed to be disposed within said window frame extrusion, and an alignment clip member associated with said window frame having a base means for positioning within said recess of said window frame, alignment clip element means adjacent to said base means having deformable tab means for adjusting the spacing between said window frame and said window receiving opening, spring means operatively associated with said base means and said alignment clip element means for biasing said base means with respect to said alignment clip element means and screw means engaging said alignment clip element means, said window frame and said window receiving opening, whereby said window frame can be adjusted to be positioned in said window receiving opening by either rotating said screw means so as to alter the spacing between said base means and said alignment clip element means or by adjusting said tab means to alter the spacing between said alignment clip element means and said window receiving opening or both.

50. The assembly of claim 49, including said alignment clip element means having a bottom wall and a first sidewall and a second sidewall, each said sidewall extending upwardly from opposite lateral portions of said alignment clip element means in a generally perpendicular relationship to said bottom wall, said tab means being secured to said sidewall and positioned in a generally spaced parallel relationship with said bottom wall.

51. The assembly of claim 50, including said tab means extending generally transversely inwardly from said sidewalls and having a hinge axis whereby said tab means is adapted to be rotated generally upwardly and outwardly at said hinge axis to assume a position generally aligned with said sidewalls.

52. The assembly of claim 51, including said sidewalls being continuous along said lateral portions of said opposite lateral portions of said alignment clip element means.

53. The assembly of claim 52, including said sidewalls being discontinuous along said lateral portions of said opposite lateral portions of said alignment clip element means.

54. The assembly of claim 52, including said alignment clip element having a plurality of tab means.

55. The assembly of claim 54, including said tab means on said first sidewall being generally aligned with said tab means on said second sidewall.

56. The assembly of claim 55, including said first sidewall having substantially the same number of tab means as said second sidewall.

57. The assembly of claim 56, including said tab means on each sidewall having at least one tab means of different width than the other tab means.

58. The assembly of claim 57, including said first sidewall having three tab means and said second sidewall having three tab means.

59. The assembly of claim 58, including said different width tab means of each said sidewall being generally aligned and being positoned between the other two said tab means.

60. The assembly of claim 59, including said different width tab means having a greater width than said other two tab means.

61. The assembly of claim 60, including said tab means having substantially the same length.

* * * * *